United States Patent [19]

Hannett et al.

[11] 4,319,459

[45] Mar. 16, 1982

[54] REFRIGERATION MACHINE AND A METHOD OF CHARGING THE SAME

[75] Inventors: William J. Hannett, Jamesville; Thomas E. Brendel, Fayetteville, both of N.Y.

[73] Assignee: Carrier Corporation, Syracuse, N.Y.

[21] Appl. No.: 205,208

[22] Filed: Nov. 7, 1980

[51] Int. Cl.[3] ..... F25B 45/00

[52] U.S. Cl. ..... 62/77; 62/292

[58] Field of Search ..... 62/125, 129, 292, 77, 62/149, 506

[56] References Cited

U.S. PATENT DOCUMENTS

| | | | |
|---|---|---|---|
| 3,162,021 | 12/1964 | Brody | 62/292 |
| 3,163,015 | 12/1964 | Spofford | 62/149 X |
| 3,200,605 | 8/1965 | Brody | 62/292 X |
| 3,481,152 | 12/1969 | Seeley | 62/506 X |
| 3,753,356 | 8/1973 | Kramer | 62/125 X |
| 3,791,165 | 2/1974 | Honnold, Jr. et al. | 62/77 |

*Primary Examiner*—William E. Wayner

*Attorney, Agent, or Firm*—J. Raymond Curtin; John S. Sensny

[57] ABSTRACT

A refrigeration machine and a method of charging the same. The machine comprises a compressor, a condenser, an expansion device, and an evaporator connected together to form a closed loop, vapor compression refrigeration circuit. The condenser includes first and second parallel refrigerant condenser coils, and refrigerant is condensed with greater efficiency in the first condenser coil than in the second condenser coil. The refrigeration machine further comprises a first sight glass for disclosing the presence of refrigerant vapor in the refrigerant fluid discharged from the first condenser coil, and a second sight glass for disclosing the presence of refrigerant vapor in the refrigerant fluid discharged from the second condenser coil.

5 Claims, 1 Drawing Figure

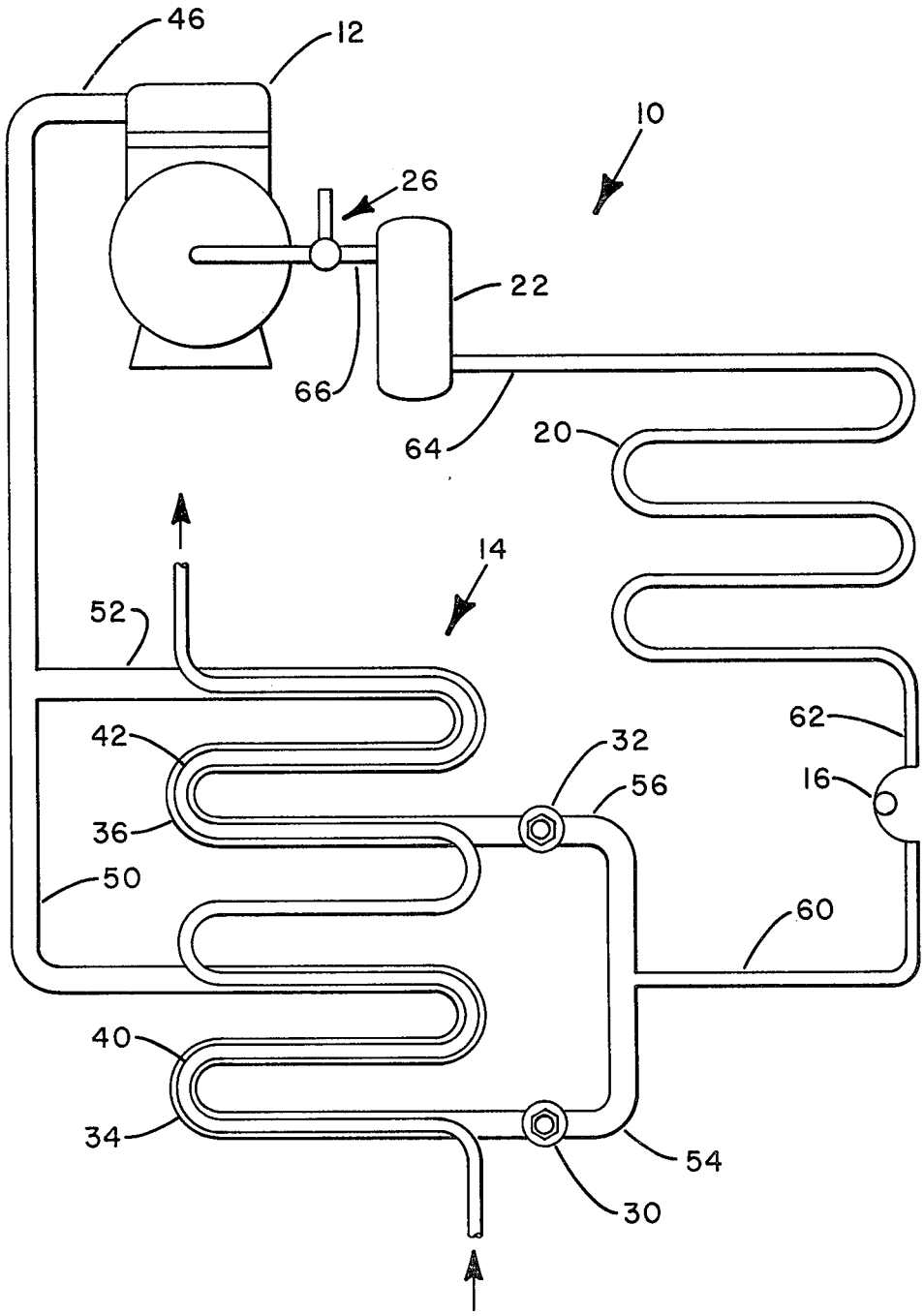
46
12
10
26
22
66
64
20
14
52
62
42
32
56
16
36
50
60
40
34
54
30

REFRIGERATION MACHINE AND A METHOD OF CHARGING THE SAME

BACKGROUND OF THE INVENTION

This invention generally relates to refrigeration machines, and more specifically to insuring that a refrigeration machine is properly charged.

As is well understood by those skilled in the art, it is highly desirable that a refrigeration machine be properly charged; that is, provided with the correct amount of refrigerant fluid. For example, if a refrigeration machine is undercharged, the machine may not be able to produce the desired cooling effect. On the other hand, if a refrigeration machine is overcharged, liquid refrigerant may enter the compressor of the machine, adversely affecting the performance thereof and possibly causing damage to the compressor. Consequently, refrigeration machines are often provided with means or apparatus to monitor or to check the charge of the machine.

Insuring that a refrigeration machine has the correct charge is particularly important if the machine includes an expansion device of the fixed size orifice type, for example a capillary tube. Such expansion devices, although relatively simple and inexpensive, operate with maximum efficiency within a comparatively narrow range of temperatures and pressures determined by the system design and charge. Heretofore, however, providing a refrigeration machine having a fixed size orifice type of expansion device with means to monitor the charge of the machine has been complicated by the fact that often such machines do not have a liquid refrigerant collection vessel located between the condenser and the expansion device of the machine, thus rendering inapplicable the many prior art charge checking methods and appartus which employ such a collection vessel.

As a result, prior art arrangements for monitoring the charge of refrigeration machines of the general type described above have been somewhat complex, elaborate, or expensive. For example, these prior art arrangements may require a special operating cycle of the refrigeration machine or that the machine temporarily shut down. These actions may adversely affect machine performance or temporarily render the machine ineffective for its intended purpose. Alternately, these methods and apparatus may require sensing or examining refrigerant fluid conditions in the area of the evaporator of the machine, an area which is often relatively inaccessible or remote. Other prior art charge checking methods and apparatus may require sensing the refrigerant pressure or temperature at a plurality of locations, requiring a considerable amount of hardware such as sensors, tubes, and gauges.

SUMMARY OF THE INVENTION

In view of the above, an object of the present invention is to improve refrigeration machines and refrigerant charging methods.

Another object of this invention is to monitor the charge of the refrigeration machine having a fixed size orifice type of expansion device in a relatively simple and inexpensive manner.

A further object of this invention is to indicate the charge of a refrigeration machine having a fixed size orifice type of expansion device by examining refrigerant fluid conditions between the condenser and the expansion device of the machine.

Another object of this invention is to observe refrigerant fluid conditions at the outlets of each of a pair of parallel refrigerant condenser coils and to compare the observed conditions to determine the charge of a refrigeration machine.

These and other objectives are attained with a refrigeration machine comprising a compressor, a condenser, an expansion device, and an evaporator connected together to form a closed loop, vapor compression refrigeration circuit. The condenser includes first and second parallel refrigerant condenser coils, and means for conducting a cooling medium over the first and second refrigerant coils to condense refrigerant conducted through the coils with different condensing efficiencies. The refrigeration machine further comprises means for disclosing the presence of refrigerant vapor in refrigerant fluid discharged from the first condenser coil, and means for disclosing the presence of refrigerant vapor in refrigerant fluid discharged from the second condenser coil.

A BRIEF DESCRIPTION OF THE DRAWING

The sole FIGURE in the drawing is a schematic representation of a refrigeration machine illustrating teachings of the present invention.

A DETAILED DESCRIPTION OF THE PREFERRED EMBODIMENT

Referring to the drawing, there is illustrated refrigeration machine 10 generally including compressor 12, condenser 14, expansion device 16, and evaporator 20. Machine 10 also includes accumulator 22, charging connection 26, and sight glasses 30 and 32. Condenser 14, in turn, includes two, parallel refrigerant coils 34 and 36 and two, serially arranged cooling coils 40 and 42, with coils 40 and 42 in heat transfer relation with refrigerant coils 34 and 36 respectively. Preferably, condenser 14 is of the tube-in-tube type with cooling coils 40 and 42 respectively located inside refrigerant coils 34 and 36, as shown in the drawing.

In operation, compressor 12 discharges hot, compressed refrigerant vapor into line 46, which conducts the vapor to lines 50 and 52. Lines 50 and 52 conduct the vapor into condenser coils 34 and 36, and the refrigerant vapor passes through these coils, rejecting heat to a cooling medium such as water flowing through coils 40 and 42. As the refrigerant vapor rejects heat to the cooling medium, refrigerant fluid condenses, and liquid refrigerant is discharged from coils 34 and 36 into condenser outlet lines 54 and 56. For reasons which will be discussed in detail below, sight glasses 30 and 32 are respectively located in outlet lines 54 and 56 to allow visual observation of the fluid discharged from refrigerant coils 34 and 36.

Refrigerant fluid flows through lines 54 and 56, into and through line 60, and thence through expansion device 16, which preferably is of the fixed size orifice type such as a capillary tube. The refrigerant expands as it passes through device 16, reducing the pressure and temperature of the refrigerant. The expanded refrigerant is conducted through line 62 and through evaporator 20, where heat is transferred to the refrigerant from an external heat exchange medium such as air moving over the evaporator. As the refrigerant passes through evaporator 20, refrigerant fluid vaporizes, and refrigerant vapor is discharged from the evaporator into line 64, which conducts the vapor into accumulator 22. Accumulator 22 is provided to collect any liquid refrigerant discharged from evaporator 20, inhibiting liquid refrigerant from entering compressor 12. Vaporous refrigerant entering accumulator 22, however, is conducted therefrom to compressor 12 via line 66, completing the refrigeration circuit.

As indicated above, refrigerant vapor condenses as it passes through coils 34 and 36. The condensation of vapor passing through coils 34 and 36 may or may not be complete, however, depending on, among other things, the length and size of the coils, the pressure of refrigerant vapor in the coils, and the temperature differential between the refrigerant fluid and the cooling medium passing through coils 40 and 42. If vapor condensation through a refrigerant coil 34 or 36 is incomplete, then a mixture of liquid and vaporous refrigerant is discharged from the coil into the associated condenser outlet line. The vapor in such a mixture is observable as vapor bubbles present in the liquid refrigerant. In contrast, if vapor condensation through a refrigerant coil 34 or 36 is complete, then all of the refrigerant discharged from the coil is in the form of liquid refrigerant, and refrigerant vapor bubbles are not present in the associated condenser outlet line.

In addition to the foregoing, it should be noted that because the cooling medium serially flows through coils 40 and 42, this medium has a slightly higher temperature when entering coil 42 than when entering coil 40. Thus, the temperature differential between refrigerant in coil 34 and the medium in coil 40 is greater than the temperature differential between refrigerant in coil 36 and the medium in coil 42. As a result of this, coil 34 operates with greater condensing efficiency than coil 36, that is, the percentage of the vapor passing through coil 34 which is condensed therein is greater than the percentage of the vapor passing through coil 36 which is condensed therein.

Applicants advantageously utilize the above-discussed features of machine 10 to insure that the machine is charged to the proper level. More particularly, to charge machine 10, refrigerant fluid is added thereto via charging connection 26. Initially, due to the below normal pressure in refrigerant coils 34 and 36, vapor condensation is incomplete in both of these coils; and refrigerant vapor bubbles, observable through sight glasses 30 and 32, are present in the fluid conducted through outlet lines 54 and 56.

As the refrigerant charge in machine 10 is gradually increased, the vapor temperature and pressure in coils 34 and 36 also increase, increasing the portion of the refrigerant vapor condensed in these coils. Eventually complete condensation of the refrigerant fluid is approached. As mentioned above, vapor is more effectively condensed in coil 34 than in coil 36. Thus, complete condensation is achieved in coil 34 before vapor condensation is complete in coil 36; and machine 10, particularly the size of the components thereof, is designed so that the machine is properly charged if condensation is complete in the former coil while still incomplete in the latter coil. At this condition, refrigerant vapor bubbles are absent from condenser outlet line 54 and substantially clear liquid refrigerant is observable through sight glass 30, while refrigerant vapor bubbles are present in outlet line 56 and observable through sight glass 32. When these conditions develop, no more refrigerant should be added to machine 10.

If, however, the refrigerant charge in machine 10 is further increased, the portion of refrigerant vapor condensed in coil 36 also increases. If the refrigerant charge increases to the level where complete condensation is achieved in coil 36, refrigerant vapor bubbles disappear from condenser outlet line 56, and substantially clear liquid is observable through both sight glasses 30 and 32. This condition may be conveniently used to indicate that machine 10 is overcharged, and when this occurs, refrigerant may be withdrawn from the machine via connection 26.

Moreover, as will be apparent to those skilled in the art, Applicants' invention may also be used to monitor simply and accurately the charge of machine 10. That is, when refrigerant vapor bubbles are observed through both sight glasses 30 and 32, machine 10 is undercharged; if refrigerant vapor bubbles are observed through sight glass 32 but absent from the refrigerant observed through sight glass 30, then machine 10 is properly charged; and when refrigerant vapor bubbles cannot be observed through either sight glass 30 or 32, machine 10 is overcharged.

It should be noted that it is not necessary, generally, to operate refrigerant coils 34 and 36 with different heat transfer efficiencies or, more particularly, to conduct a cooling medium serially past these coils in order to operate the parallel refrigerant coils 34 and 36 with different condensing efficiencies. While the arrangement described above in detail is preferred, other arrangements may be used to condense a greater percentage of the refrigerant conducted through coil 34 than conducted through coil 36. For example, coils 34 and 36 may have different sizes or lengths, the refrigerant fluid may be conducted through these coils at different flow rates, or the cooling medium may be conducted over coils 34 and 36 at different flow rates.

As may be appreciated from a review of the above discussion, Applicants have provided a very simple and economical yet accurate refrigerant charging method which may be conveniently and effectively employed with a refrigeration machine having a fixed size orifice type of expansion device. Further, by employing the present invention, the charge of machine 10 may be monitored without requiring a special operating cycle of the machine or that the machine temporarily shut down. The present invention also is capable of disclosing both an overcharge and an undercharge and, moreover, distinguishing between these two situations. In addition, the machine charge is allowed to fluctuate within a range, albeit a relatively narrow range, before the charge checking apparatus indicates an improper charge. Thus, minute, practically insignificant changes in the refrigerant charge will not result in an indication that the machine is improperly charged and in the associated efforts and costs to correct the charge.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. A method of charging a refrigeration machine having first and second parallel refrigerant condenser coils, the method comprising the steps of:

adding refrigerant to the machine;

conducting refrigerant through the first and second refrigerant condenser coils;

condensing a percentage of the refrigerant conducted through the first refrigerant condenser coil, and condensing a lesser percentage of the refrigerant conducted through the second refrigerant condenser coil; and terminating the addition of refrigerant when refrigerant vapor bubbles are absent from the refrigerant discharged from the first refrigerant condenser coil but present in the refrigerant discharged from the second refrigerant coil.

2. A method as defined by claim 1 further including the step of withdrawing refrigerant from the machine when refrigerant vapor bubbles are absent both from the refrigerant discharged from the first refrigerant condenser coil and from the refrigerant discharged from the second refrigerant condenser coil.

3. A method as defined by claim 2 wherein the condensing step includes the step of serially conducting a cooling medium past the first and second refrigerant condenser coils.

4. A method as defined by claim 3 wherein the terminating step includes the step of visually observing the refrigerant discharged from the first and second refrigerant condenser coils.

5. A refrigeration machine comprising:

a compressor;

first and second parallel refrigerant condensing coils;

an expansion device including means defining a fixed sized orifice;

an evaporator;

a compressor discharge line for receiving refrigerant from the compressor;

a first condenser inlet line for conducting refrigerant from the compressor discharge line to the first condenser coil;

a second condenser inlet line for conducting refrigerant from the compressor discharge line to the second condenser coil;

means for conducting a cooling medium serially over the first and second refrigerant condensing coils, wherein a percentage of the refrigerant conducted through the first refrigerant condensing coil is condensed therein and a greater percentage of the refrigerant conducted through the second refrigerant condensing coil is condensed therein;

a first condenser outlet line for receiving refrigerant from the first condensing coil;

a second condenser outlet line for receiving refrigerant from the second condensing coil;

a refrigerant line for receiving refrigerant from the first and second condenser outlet lines and conducting the refrigerant to the expansion device;

a first sight glass disposed in the first condenser outlet line to disclose the presence of refrigerant vapor in refrigerant fluid discharged from the first refrigerant condensing coil; and a second sight glass disposed in the second condenser outlet line, parallel to the first sight glass, to disclose the presence of refrigerant vapor in refrigerant fluid discharged from the second refrigerant condensing coil;

whereby the first and second sight glasses in combination disclose when the quantity of refrigerant in the refrigeration machine is above a first level, when said quantity is below a second, lower level, and when said quantity is within a range between the first and second levels.

* * * * *